US008403184B2

(12) United States Patent
Eberhardt et al.

(10) Patent No.: US 8,403,184 B2
(45) Date of Patent: Mar. 26, 2013

(54) CAP FOR AN AEROSOL CAN OR A SPRAY CAN, WITH AN ACOUSTIC SEAL

(75) Inventors: Heiko Eberhardt, Oberursel (DE); Robert Goetz, Frankfurt am Main (DE)

(73) Assignee: Wella GmbH, Schwalbach am Taunus (DE)

( * ) Notice: Subject to any disclaimer, the term of this patent is extended or adjusted under 35 U.S.C. 154(b) by 841 days.

(21) Appl. No.: 11/720,778

(22) PCT Filed: Nov. 22, 2005

(86) PCT No.: PCT/EP2005/012482

§ 371 (c)(1), (2), (4) Date: Oct. 21, 2009

(87) PCT Pub. No.: WO2006/061099

PCT Pub. Date: Jun. 15, 2006

(65) Prior Publication Data

US 2010/0044401 A1 Feb. 25, 2010

(30) Foreign Application Priority Data

Dec. 9, 2004 (DE) ..... 10 2004 059 204

(51) Int. Cl.
*B65D 83/00* (2006.01)

(52) U.S. Cl. ..... 222/402.13; 222/39; 222/182; 222/402.1

(58) Field of Classification Search ..... 222/39, 222/182, 402.1, 402.13, 402.21, 402.24
See application file for complete search history.

(56) References Cited

U.S. PATENT DOCUMENTS

| | | | | |
|---|---|---|---|---|
| 3,785,528 | A * | 1/1974 | Mandeltort | 222/148 |
| 4,095,725 | A * | 6/1978 | Goncalves | 222/153.06 |
| 4,506,808 | A | 3/1985 | Goncalves | |
| 5,624,055 | A * | 4/1997 | Clanet et al. | 222/135 |
| 6,145,704 | A * | 11/2000 | Geier | 222/153.06 |
| 6,318,595 | B1 * | 11/2001 | Walters | 222/1 |
| 7,104,427 | B2 * | 9/2006 | Pericard et al. | 222/402.13 |
| 2007/0262095 | A1 * | 11/2007 | Eberhardt | 222/402.13 |

FOREIGN PATENT DOCUMENTS

| | | |
|---|---|---|
| DE | 201 06 896 | 8/2001 |
| EP | 0 669 268 | 8/1995 |
| FR | 2 814 727 | 4/2002 |
| WO | 01/96210 | 12/2001 |

* cited by examiner

*Primary Examiner* — Kevin P Shaver
*Assistant Examiner* — Nicholas Weiss
(74) *Attorney, Agent, or Firm* — Michael J. Striker

(57) ABSTRACT

For acoustic sealing of a spray cap (7) for an aerosol can or spray can, the spray cap includes a push button (6) and a nap body (7*a*) and is provided with an acoustic seal (49) between the push button (6) and the cap body (7*a*). The acoustic seal (49) includes a sealing lip (8) on a rim (7*b*) of the cap body (7*a*) and another sealing lip (9) on an adjacent rim (6*a*) of the push button (6). A pleasing sound is produced when product is discharged from the aerosol or spray can by manually actuating the push button, since the push button (6) is configured integral with a spray channel (10) connecting a valve stem (11) with a discharge opening (3) provided in the cap body (7).

3 Claims, 3 Drawing Sheets

CAP FOR AN AEROSOL CAN OR A SPRAY CAN, WITH AN ACOUSTIC SEAL

CROSS-REFERENCE

This is the U.S. National Stage of PCT/EP 2005/012482, filed on Nov. 22, 2005, which, in turn, claims benefit of priority of invention based on German Patent Application 10 2004 059204.7, filed on Dec. 9, 2004 in Germany. The invention claimed and described herein below is also described in the aforesaid German Patent Application.

BACKGROUND OF THE INVENTION

1. The Field of the Invention

The invention relates to a cap for a container, especially an aerosol can or a spray can, having a push button for manual actuation and for the delivery of the product present in the container, e.g. hair spray, from a product discharge opening in the cap.

2. The Description of the Related Art

From WO 01/96210, it is known to seal such a cap in order to obtain an agreeable spraying noise during discharge of a product. Here, the hinge-mounted push button acts via a separate angled-off spray channel against a stem (product discharge tube) of the container in order to deflect the stem through manual actuation of the push button and in order thereby to open a valve present in the container, whereby the product contained in the container escapes through the stem, the spray channel and a product discharge opening provided on the cap. A seal in the form of two sealing lips between the push button and the cap ensures an acoustic sealing of the cap.

From EP 0669268 A1, a pivotable push button without a fixed joint is known, which is configured in one piece together with the cap and which has a circumferential fold as the seal between the cap and the push button. Upon actuation, the fold is steadily stretched on one side, while on the opposite side it is compressed.

The known cap of the type stated in the introduction has the drawback that it does not utilize the push button in optimal form as a resonance body.

SUMMARY OF THE INVENTION

The object of the invention is to eliminate this drawback and to utilize a push button in the form of a resonant body that produces a pleasant sound when product is discharged from the can.

The object is achieved by the fact that the hinge-mountable push button is integrally constructed together with the spray channel.

The proposed cap has the advantage that a spray channel can be manufactured integrally together with the push button and therefore cost-effectively. This component can then be inserted into a traditional cap. The spray channel, which is set vibrating as the product is discharged, can transmit the vibrations directly to the push button. This gives rise to resonances, which produce an agreeable spray-out sound.

The manufacture of the entire spray cap becomes still more favorable if, in addition, a nozzle is integrally configured together with the spray channel and the push button.

The proposed one-piece constructions can be made by means of an injection molding process. Such a part can be easily inserted into a cap if the push button is articulately connected by a plug connection to the inner side of the cap.

The seal can be fitted to the outer rim of the push button and likewise to a circumferential, upper rim of the cap. In an advantageous embodiment, the push button is round, e.g. oval or circular, and extends circumferentially around the push button. In this embodiment, the actuation force is relatively uniform if the seal is formed from a sealing lip on the rim of the cap and a further sealing lip on the rim of the push button.

The sealing of the push button with respect to the cap is optimized and is realized with minimal manufacturing costs if the height of the sealing lip of the cap is ever greater, the farther removed is the corresponding region of the sealing lip from the joint. In this case, a secure seal is still obtained even when the push button is fully pressed.

BRIEF DESCRIPTION OF THE DRAWING

The invention is described in greater detail below with reference to an illustrative embodiment, in which.

DESCRIPTION OF THE PREFERRED EMBODIMENT

Figure 1:
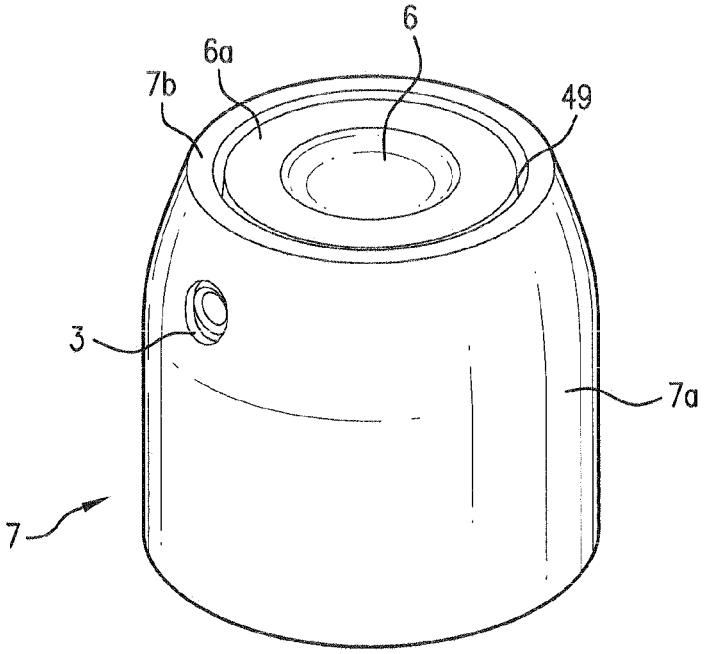
FIG. 1 is a perspective view of a cap having a round push button, provided with a circumferential acoustic seal, for mounting on an aerosol can.
Figure 2:
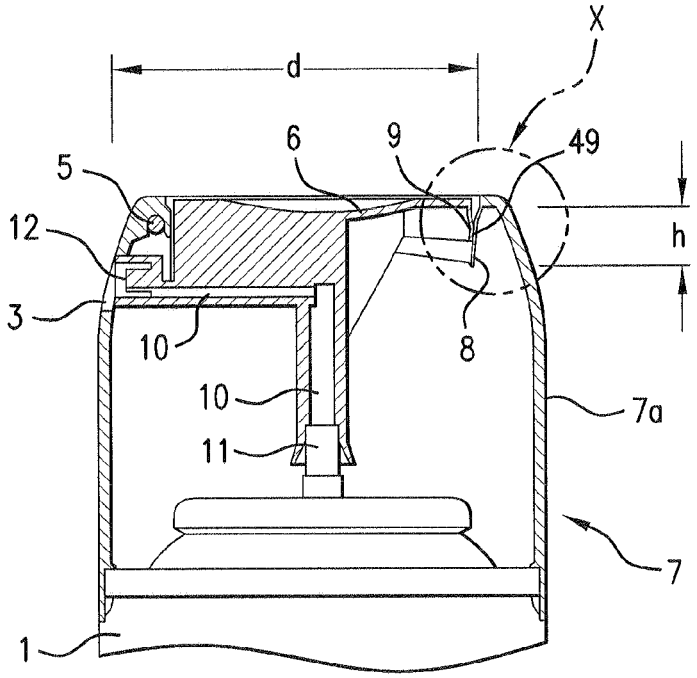
FIG. 2 is a vertical cross-sectional view through the cap of FIG. 1, mounted on a container, with non-actuated push button.
Figure 3:
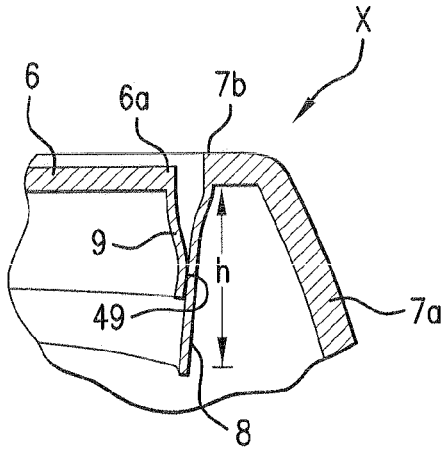
FIG. 3 is a detailed vertical cross-sectional view of a part X of the cap shown in FIG. 2, which shows the acoustic seal, constructed in the form of sealing lips, between the cap and the push button.
Figure 4:
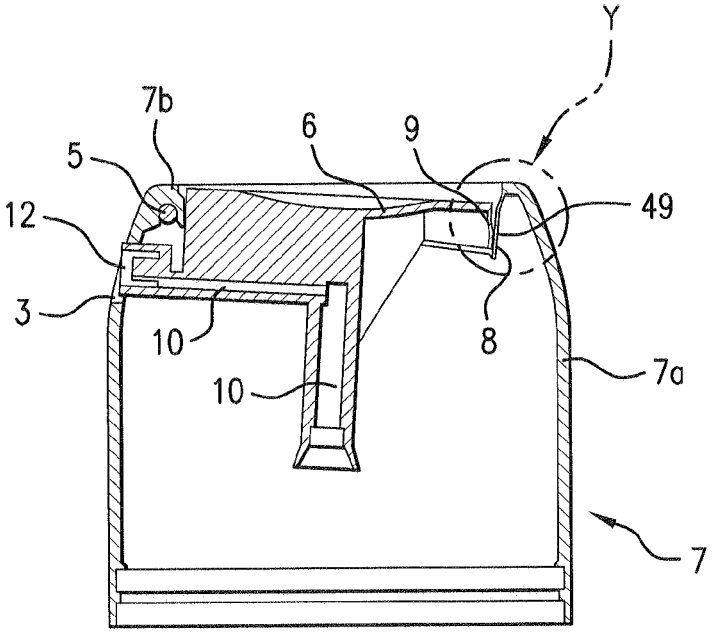
FIG. 4 is a vertical cross-sectional view of the cap of FIG. 2, but with the push button pressed in order to manually actuate the valve and dispense product.
Figure 5:
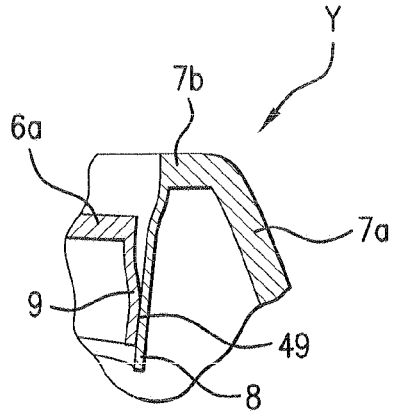
FIG. 5 is a detailed vertical cross-sectional view of a part Y of the cap shown in FIG. 4.
Figure 6:
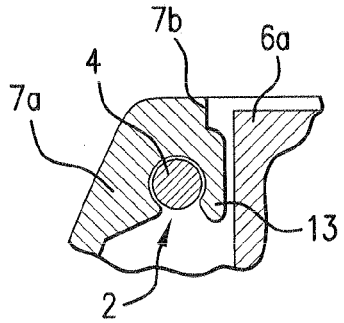
FIG. 6 is a detailed vertical cross-sectional view showing the articulate attachment of the push button to the cap.
Figure 7:
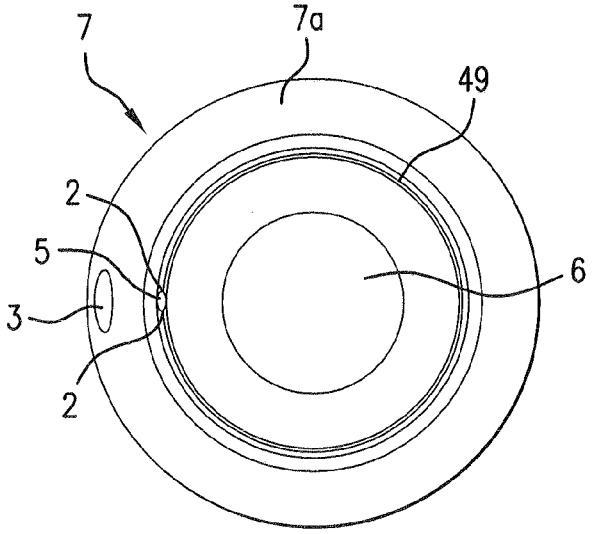
FIG. 7 is a top plan view of the cap shown in FIG. 1.

In a spray cap 7 according to one embodiment of the invention a push button 6 serves to actuate a valve (not shown in FIG. 1) of a container 1, which is constructed as an aerosol can and contains hair spray. The push button 6, which is pivotable about a joint 5, is designed to act via an angled-off spray channel 10 against a stem 11 of the container 1, in order to deflect the stem 11 upon manual actuation of the push button 6 and thus to open the valve, whereby product contained in the container 1 escapes through the stem 11 and a product discharge opening 3 provided on the cap 7, passing the spray channel 10 and a nozzle 12. In this case, a seal 49 between the push button 6 and a cap body 7*a* of the cap 7 acts as an acoustic seal 49 for the cap 7 in order to obtain a spraying sound agreeable to a customer. The seal 49 is formed from a sealing lip 8 on a rim 7*b* of the cap body 7*a* and a further sealing lip 9 on a rim 6*b* of the push button 6. In the preferred embodiment the height (h) of the sealing lip 8 is ever greater, the farther removed is the corresponding region of the sealing lip 8 from the joint 5, i.e. the greater is the distance (d) between the sealing lip 8 and the joint 5.

The push button is round in construction and the seal 49 extends circumferentially around the push button 6. It hermetically seals the area between the cap body 7*a* and the push button 6.

The push button 6, the spray channel 10 and the nozzle 12 are integrated within a single component. This component has been snapped into the inner side of the cap body 7*a* via a plug connection 2, which constitutes the joint 5. This variant is also suitable for spray caps in which, following their completion, a further seal 49 is due to be subsequently inserted. For snapping in of the component, pins 4 configured on opposite sides of the push button 6 are respectively snapped into a receiving fixture 13 hollowed out in the cap 7.

PARTS LIST

1 Container
2 plug connection
3 product discharge opening
4 Pin
5 Joint
6 push button
6*a* rim of the push button
7 Cap
7*a* cap body
7*b* rim of the cap body
8, 9 sealing lip
10 spray channel
11 Stem
12 Nozzle
13 receiving fixture
49 Seal
h height of the sealing lip 8
d distance between the seal and the joint

The invention claimed is:

1. A cap (7) for an aerosol can or a spray can, said can comprising a valve through which product contained in the can passes when a valve stem (11) of the valve is deflected, wherein said cap comprises a push button (6) that is pivotable about a joint (5);

a cap body (7*a*) provided with a product discharge opening (3), said push button (6) being pivotally connected by a plug connection (2) to an inner side of the cap body (7*a*);

an angled-off spray channel (10) integral with the push button (6) and configured to act against the valve stem (11) when the push button (6) is manually actuated, so that the stem (11) is deflected and the valve opened, whereby the product contained in the can passes through the valve stem (11), through the spray channel (10), and is discharged through the product discharge opening (3); and an acoustic seal (49) between the push button (6) and the cap body (7*a*), said acoustic seal (49) extending circumferentially around the push button (6) and being formed by a sealing lip (8) on a rim (7*b*) of the cap body (7*a*) and another sealing lip (9) on an adjacent rim (6*a*) of the push button (6);

wherein the acoustic seal hermetically seals are ion between the S push button (6) and the cap body (7*a*) even when the push button (6) is completely depressed;

wherein the sealing lip (8) of the rim (7*b*) of the cap body (7*a*) has a height (h) that becomes larger as a distance (d) of the sealing lip (8) from the joint (5) increases.

2. The cap as claimed in claim 1, wherein a nozzle (12) arranged at the product discharge opening (3) is integrally configured together with the spray channel (10) and the push button (6).

3. The cap as claimed in claim 1, wherein the push button (6) is circular or oval.

* * * * *